US011536058B2

(12) United States Patent
Han et al.

(10) Patent No.: US 11,536,058 B2
(45) Date of Patent: Dec. 27, 2022

(54) STRUCTURE FOR CONNECTING DOOR LATCH CABLE TO RETRACTABLE OUTSIDE DOOR HANDLE ASSEMBLY FOR VEHICLE

(71) Applicants: Hyundai Motor Company, Seoul (KR); Kia Motors Corporation, Seoul (KR)

(72) Inventors: Jungho Han, Seoul (KR); Kyoung Taek Kwak, Yongin-si (KR); Jinwoo Nam, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 913 days.

(21) Appl. No.: 16/395,953

(22) Filed: Apr. 26, 2019

(65) Prior Publication Data

US 2020/0071969 A1 Mar. 5, 2020

(30) Foreign Application Priority Data

Aug. 31, 2018 (KR) ..... 10-2018-0103491
Feb. 11, 2019 (KR) ..... 10-2019-0015763

(51) Int. Cl.
*E05B 79/20* (2014.01)
*E05B 79/02* (2014.01)
*E05B 85/10* (2014.01)

(52) U.S. Cl.
CPC ..... *E05B 79/20* (2013.01); *E05B 79/02* (2013.01); *E05B 85/107* (2013.01); *E05Y 2900/531* (2013.01)

(58) Field of Classification Search
CPC ..... E05B 79/20; E05B 79/02; E05B 85/107; Y10S 292/53; Y10S 292/54; Y10S 292/64
See application file for complete search history.

(56) References Cited

U.S. PATENT DOCUMENTS

| | | | |
|---|---|---|---|
| 3,418,681 | A | 12/1968 | Szabo |
| 3,993,338 | A | 11/1976 | Cherbourg et al. |
| 4,093,289 | A | 6/1978 | Inabayashi et al. |
| 4,573,723 | A | 3/1986 | Morita et al. |
| 4,885,954 | A | 12/1989 | Wanlass |
| 5,088,347 | A | 2/1992 | Wanlass |

(Continued)

FOREIGN PATENT DOCUMENTS

| | | | |
|---|---|---|---|
| CN | 101899931 | A | 12/2010 |
| CN | 204754512 | U | 11/2015 |

(Continued)

OTHER PUBLICATIONS

Extended European Search Report dated May 20, 2019.
United States Patent and Trademark Office, Office Action issued in U.S. Appl. No. 16/207,873, dated May 28, 2021, 24 pages.

*Primary Examiner* — Kristina R Fulton
*Assistant Examiner* — James Edward Ignaczewski
(74) *Attorney, Agent, or Firm* — Slater Matsil, LLP

(57) ABSTRACT

A structure can be used for connecting a door latch cable to a retractable outside door handle assembly for a vehicle. A mounting housing is inserted into a case of the retractable outside door handle assembly in a longitudinal direction of the vehicle and hanged by and mounted at the case in a height direction of the vehicle. A door latch cable is movably installed at the mounting housing.

20 Claims, 5 Drawing Sheets

(56) References Cited

U.S. PATENT DOCUMENTS

| | | | | |
|---|---|---|---|---|
| 5,123,687 | A | 6/1992 | Pfeiffer et al. | |
| 5,558,372 | A | 9/1996 | Kapes et al. | |
| 5,975,597 | A | 11/1999 | Makiuchi et al. | |
| 8,684,435 | B1 * | 4/2014 | Lee | E05B 85/12 16/110.1 |
| 9,022,435 | B2 | 5/2015 | Park et al. | |
| 9,103,143 | B2 | 8/2015 | Wheeler et al. | |
| 10,024,084 | B2 * | 7/2018 | Choi | E05B 83/40 |
| 10,072,448 | B2 | 9/2018 | Puscas et al. | |
| 10,167,656 | B2 | 1/2019 | Park et al. | |
| 10,309,133 | B2 | 6/2019 | Han et al. | |
| 10,378,254 | B1 | 8/2019 | Salter et al. | |
| 10,550,611 | B2 | 2/2020 | Och | |
| 10,655,371 | B2 | 5/2020 | Soonthornwinate et al. | |
| 10,907,387 | B2 | 2/2021 | Och et al. | |
| 10,941,595 | B2 | 3/2021 | Patel et al. | |
| 2002/0117864 | A1 | 8/2002 | Schlack | |
| 2003/0111845 | A1 * | 6/2003 | Sadler | E05C 9/043 292/336.3 |
| 2004/0074326 | A1 | 4/2004 | Minasian et al. | |
| 2010/0301618 | A1 | 12/2010 | Costigan et al. | |
| 2013/0038074 | A1 | 2/2013 | Mori et al. | |
| 2013/0127185 | A1 | 5/2013 | Lang et al. | |
| 2013/0241215 | A1 | 9/2013 | Halliwell et al. | |
| 2014/0047773 | A1 | 2/2014 | Johnsrud et al. | |
| 2015/0315826 | A1 | 11/2015 | Lang et al. | |
| 2016/0060908 | A1 * | 3/2016 | Kim | E05B 79/20 292/336.3 |
| 2016/0281397 | A1 * | 9/2016 | Park | E05B 85/103 |
| 2016/0298366 | A1 | 10/2016 | Och | |
| 2017/0218667 | A1 | 8/2017 | Lane et al. | |
| 2018/0058113 | A1 * | 3/2018 | Han | E05B 85/103 |
| 2020/0371890 | A1 | 11/2020 | De Rochebouet et al. | |
| 2020/0386019 | A1 * | 12/2020 | Jeong | E05B 85/16 |

FOREIGN PATENT DOCUMENTS

| | | | |
|---|---|---|---|
| CN | 106193844 | A | 12/2016 |
| CN | 107780729 | A | 3/2018 |
| CN | 108222714 | A | 6/2018 |
| DE | 1457243 | A1 | 1/1969 |
| DE | 4002963 | C1 | 7/1991 |
| DE | 19808024 | A1 | 9/1999 |
| DE | 102007002700 | A1 | 7/2008 |
| DE | 102014005797 | A1 | 10/2015 |
| DE | 102015209852 | A1 | 12/2016 |
| DE | 102016112689 | A1 | 1/2018 |
| GB | 2536671 | A | 9/2016 |
| JP | S52134920 | U | 10/1977 |
| JP | H06193329 | A | 7/1994 |
| JP | 2006336230 | A | 12/2006 |
| JP | 2018115544 | A | 7/2018 |
| KR | 1920090050830 | A | 5/2009 |
| KR | 101637820 | B1 | 7/2016 |
| WO | 2011086144 | A1 | 7/2011 |
| WO | 2016188663 | A1 | 12/2016 |
| WO | 2018010939 | A1 | 1/2018 |

* cited by examiner

STRUCTURE FOR CONNECTING DOOR LATCH CABLE TO RETRACTABLE OUTSIDE DOOR HANDLE ASSEMBLY FOR VEHICLE

CROSS-REFERENCE TO RELATED APPLICATIONS

This application claims priority to Korean Patent Application No. 10-2019-0015763, filed in the Korean Intellectual Property Office on Feb. 11, 2019, and Korean Patent Application No. 10-2018-0103491, filed in the Korean Intellectual Property Office on Aug. 31, 2018, the entire contents of which are incorporated herein by reference.

TECHNICAL FIELD

The present invention relates to a retractable outside door handle assembly for a vehicle.

BACKGROUND

In general, a vehicle has a predetermined size of passenger compartment formed therein for boarding of a driver and accompanying occupants, and passenger compartment opening/closing doors are provided for opening/closing the passenger compartment.

For easily opening and closing the passenger compartment opening/closing door by the passenger, an inside door handle is mounted on an inside face toward the passenger compartment inside of the door, and an outside door handle is mounted on an outside face toward the passenger compartment outside of the door.

Each door handle is connected to be interworked with a door latch to fix the door to a vehicle body, such that the door may be opened while the door latch is released according to an operation of each door handle.

The outside door handle is generally mounted to be pivotally movable to the outer panel of the door, and in this case, the outside door handle is installed on the door outer panel to be protruded outside along a width direction of the vehicle so that the passenger may easily hold the outside door handle.

As above-described, if the outside door handle is installed to be protruded outside along a width direction of the vehicle, operation convenience of the passenger is improved. However, exterior beauty of the vehicle may be deteriorated due to the protruded outside door handle. Also, a running noise may not be only caused in traveling of the vehicle, but also running performance may be also deteriorated due to running resistance.

Recently, to solve these problems, a retractable outside door handle has been developed. In particular, the outside door handle is protruded outside along the width direction of the vehicle from the door outer panel or is received inside a receiving hole formed in the door outer panel by the driving of an actuator (a motor) to not be protruded from the door outer panel outside.

The conventional retractable outside door handle assembly may have the outside door handle protrude from the door outer panel via a link mechanism or may receive it inside the receiving hole of the door outer panel through the actuator, and is connected to a door lock mechanism including a key cylinder capable of being operated for locking or releasing the door to the vehicle body and a door latch mechanism directly locking or releasing the door to/from the vehicle body.

However, in the structure of the conventional retractable outside door handle assembly, since the link mechanism retracting the outside door handle is configured of four-node links, to elongate a protruding length of the outside door handle for the operation convenience of the user, the length of the four-node links must be long, and accordingly, since the size of the handle housing must be increased, there are drawbacks that weight and cost are increased and the exterior beauty of the protruded outside door handle is also not satisfied.

Thus, the present applicant has filed an application for a retractable outside door handle assembly for a vehicle on Aug. 31, 2018 with application No. 10-2018-0103491. The present invention intends to improve the connection structure of the door latch cable in the invention to improve the assemble property and the operational reliability of a door latch cable.

The above information disclosed in this Background section is only for enhancement of understanding of the background of the invention and therefore it may contain information that does not form the prior art that is already known in this country to a person of ordinary skill in the art.

SUMMARY

The present invention relates to a retractable outside door handle assembly for a vehicle. Particular embodiments of the present invention relate to a structure for connecting a door latch cable to a retractable outside door handle assembly for a vehicle in which an outside door handle is received inside a door outer panel or protruded outside the door outer panel.

Embodiments of the present invention provide a structure for connecting a door latch cable to a retractable outside door handle assembly for a vehicle having advantages of allowing the outside door handle assembly and the door latch cable to be easily assembled in an assembly line, thereby improving assembly productivity and cost reduction, and preventing mis-assembly to shorten assembly time.

A structure for connecting a door latch cable to retractable outside door handle assembly for a vehicle according to an exemplary embodiment of the present invention may include a mounting housing inserted into a case of the retractable outside door handle assembly for the vehicle in a longitudinal direction of the vehicle and hanged by and mounted at the case in the height direction. A door latch cable can be movably installed at the mounting housing.

The mounting housing may include a housing body in which a guide groove is formed. A cable end portion, which is inserted into and moves along the guide groove, may be at mounted one end portion of the door latch cable.

The housing body may include both side walls defining the guide groove. The cable end portion is supported by both walls the side not to be separated therefrom.

The retractable outside door handle assembly for the vehicle may be provided with a link pin, which pulls and moves the cable end portion according to the operation of an outside door handle.

A first flange and a second flange may be provided at a front surface and a rear surface of the housing body in a longitudinal direction of the vehicle. The case may be provided with a catch housing into which the first mounting flange is inserted to be hanged and a hanging flange which the second mounting flange is hanged at in a height direction of the vehicle and seated thereon.

A side surface of the second mounting flange may be provided with a seating jaw seated on the hanging flange when the second mounting flange is hanged at the hanging flange in order that the second mounting flange does not fall from the hanging flange downwards in the height direction of the vehicle.

The case may be provided with an extension surface which the cable end portion is seated on and supported by.

In accordance with a structure for connecting a door latch cable to retractable outside door handle assembly for a vehicle according to an exemplary embodiment of the present invention, it allows the outside door handle assembly and the door latch cable to be easily assembled in an assembly line, thereby improving assembly productivity and reducing cost.

Further, when assembling the door latch cable to the case of the retractable outside door handle assembly in the production line of the vehicle, it is possible to shorten the assemble time by preventing mis-assembly. After the door latch cable is assembled to the case of the retractable outside door handle assembly, the cable is prevented from being detached from the case, and the reliability of the product and the like can be improved.

Figure 1:
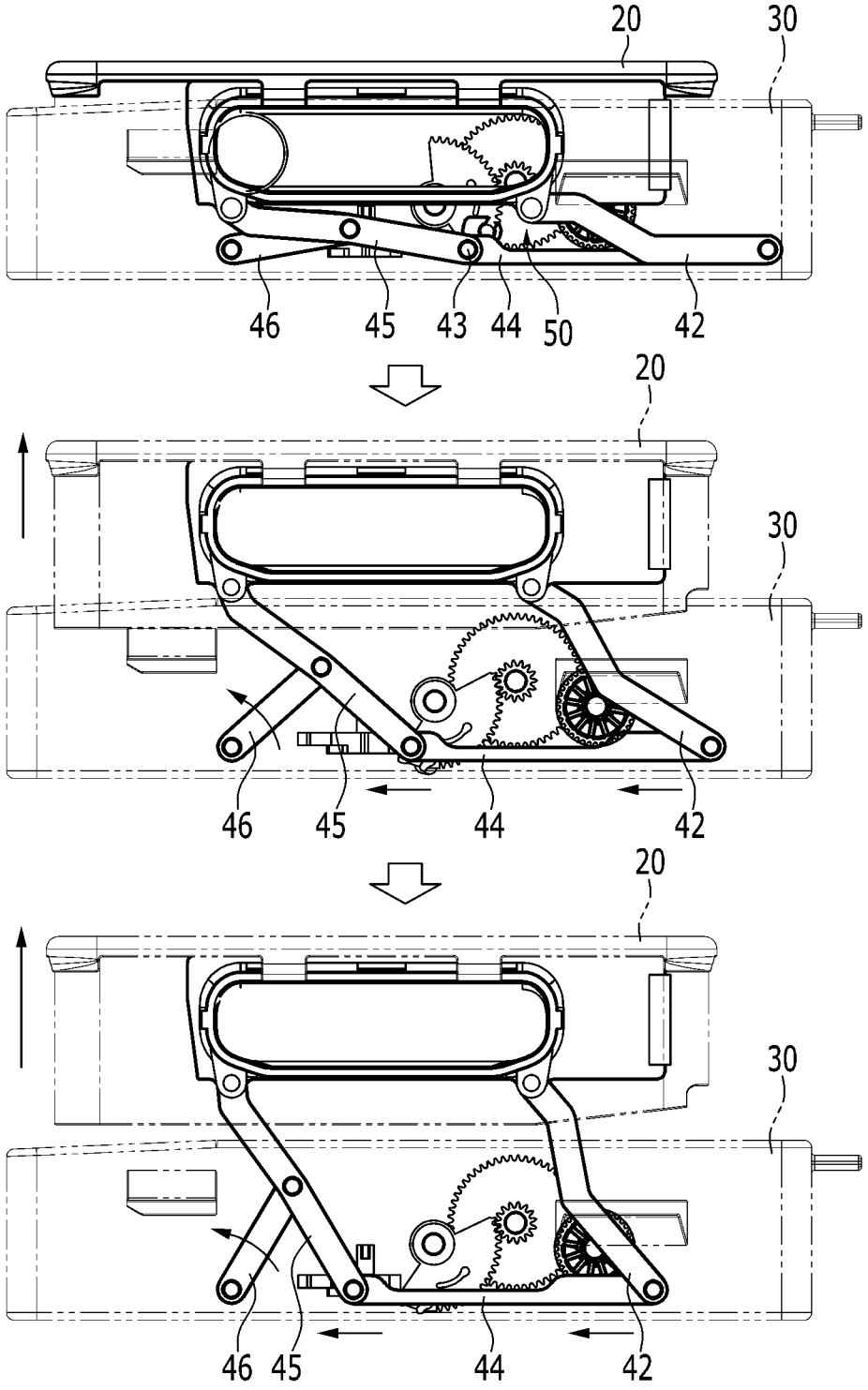
FIG. 1 is a drawing explaining an operation of a retractable outside door handle assembly for a vehicle to which an exemplary embodiment of the present invention is applied.

The following reference symbols can be used in conjunction with the drawings:

10: cable end portion
11: door latch cable
12: mounting housing
13: guide groove
14: housing body
15: side wall
16, 17: flange
18: seating jaw
20: outside door handle
30: case
31: catch housing
32: hanging flange
33: extension surface

DETAILED DESCRIPTION OF ILLUSTRATIVE EMBODIMENTS

Hereinafter, an exemplary embodiment of the present invention will be described in detail with reference to the accompanying drawings.

Referring to FIG. 1, in a retractable outside door handle assembly for a vehicle to which an exemplary embodiment of the present invention is applied, as shown in FIG. 6 of an application number KR 10-2018-0103491 of the present applicant (which is incorporated herein by reference), a connecting link 44 of a link mechanism is moved rearwards in a longitudinal direction of a vehicle by an operation of an actuator 50, so that a front link 42 and a rear link 45 are deployed outwardly in a width direction of the vehicle to protrude an outside door handle 20 outward in the vehicle width direction and the outside door handle 20 is protrude further outward than a door outer panel in the width direction of the vehicle. Thus, a passenger inserts the hand into a holding hole of the outside door handle 20 and pulls the outside door handle 20 so that a door latch cable is pulled in conjunction with the movement of the outside door handle 20 to release a door latch, and it is possible to open a door.

In this process, a link pin 43 connecting the connecting link 44 and the rear link 45 moves rearwards along the longitudinal direction of a vehicle, and the door latch cable is pulled by the link pin 43 to release the door latch.

Figure 2:
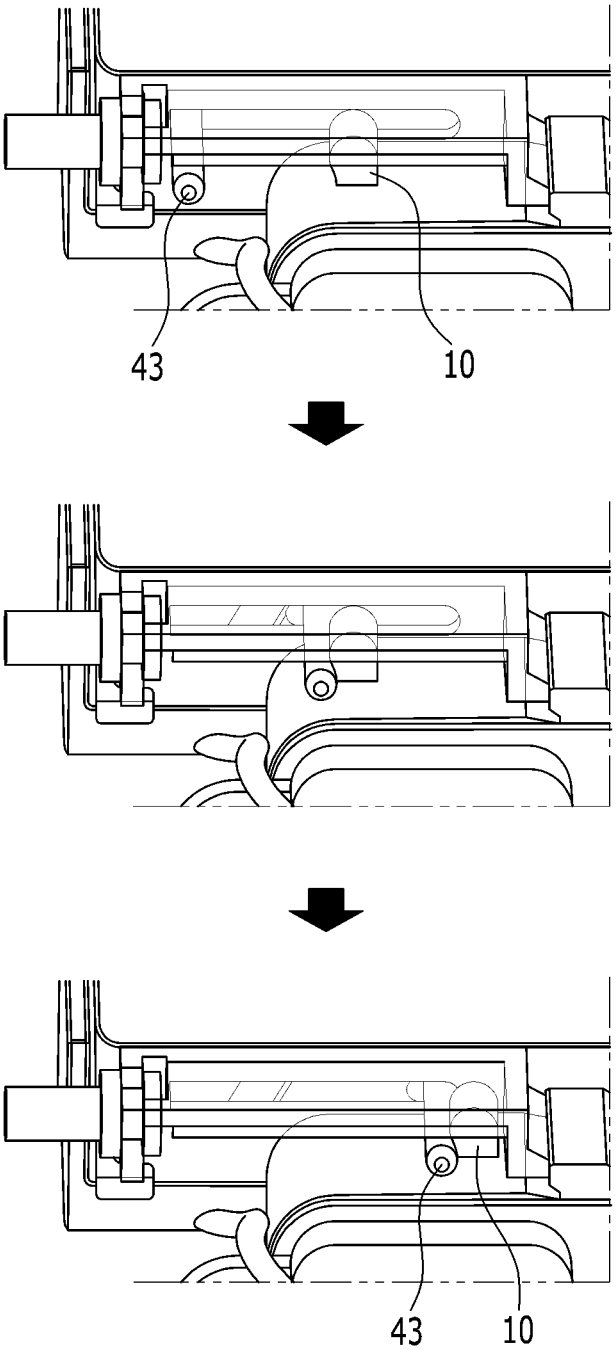
FIG. 2 is a drawing explaining the operation of a door latch cable by the operation of an outside door handle in a structure for connecting a door latch cable to a retractable outside door handle assembly for a vehicle according to an exemplary embodiment of the present invention.

That is, as shown in FIG. 2, the link pin 43, in conjunction with the movement of the outside door handle 20, pulls the cable end portion 10 of the door latch cable as it moves rearwards along the longitudinal direction of the vehicle so that the door latch connected to the door latch cable can be released.

Figure 3:
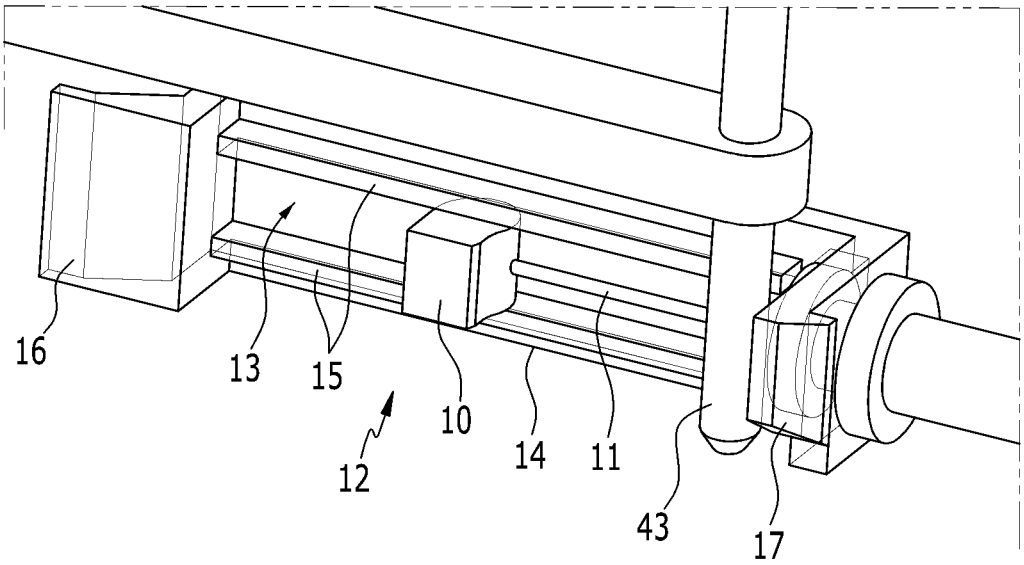
FIG. 3 is a perspective view of a structure for connecting a door latch cable to a retractable outside door handle assembly for a vehicle according to an exemplary embodiment of the present invention.
Figure 4:
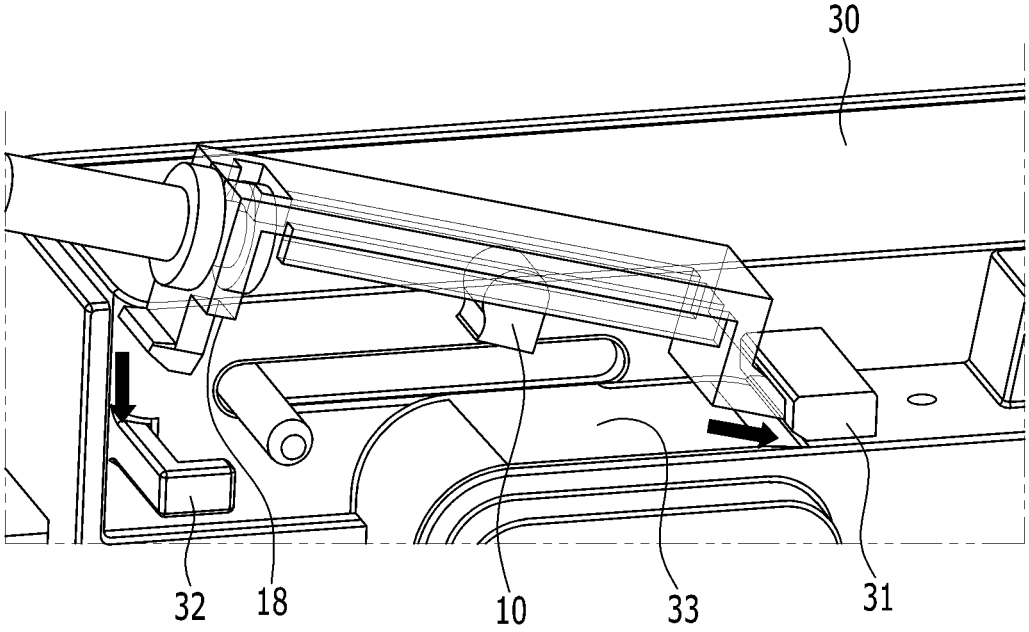
FIG. 4 is an explaining drawing of mounting of a structure for connecting a door latch cable to a retractable outside door handle assembly for a vehicle according to an exemplary embodiment of the present invention.
Figure 5:
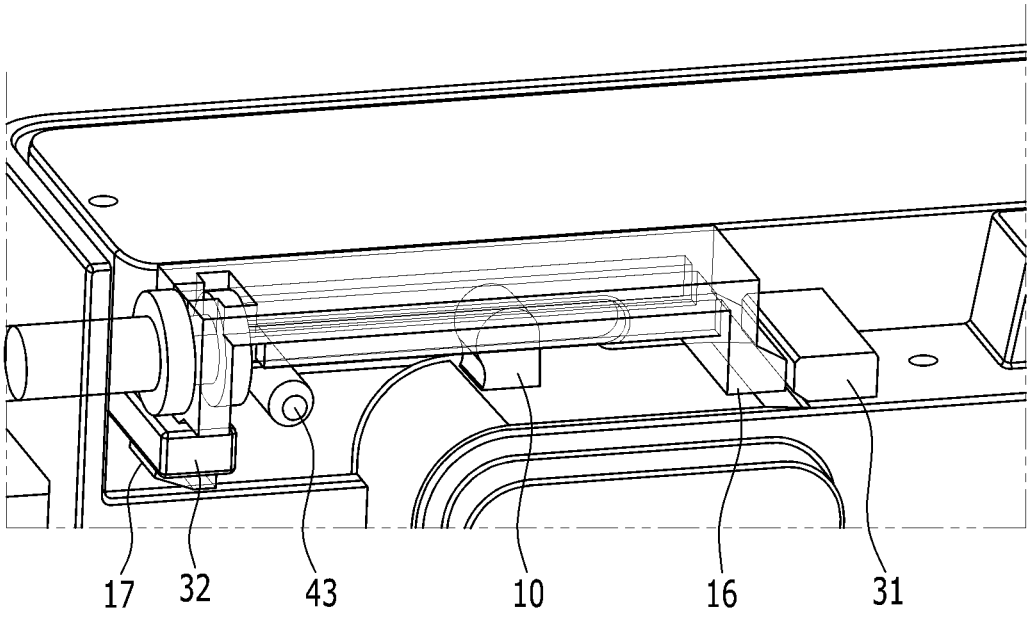
FIG. 5 is a perspective view of mounting state where a door latch cable is connected to the retractable outside door handle assembly for the vehicle according to an exemplary embodiment of the present invention.

Referring to FIGS. 3 to 5, a structure for connecting a door latch cable to a retractable outside door handle assembly for a vehicle according to an exemplary embodiment of the present invention may include, a mounting housing 12 of a door latch cable which a door latch cable 11 is movably inserted into and mounted at a case 30 of the retractable outside door handle assembly for the vehicle.

The cable end portion 10 can be fixedly assembled to one end portion of the door latch cable 11.

The other end portion of the door latch cable 11 may be connected with a door latch (not shown) so that the door latch can be released when the door latch cable 11 is pulled through the cable end portion 10.

The mounting housing 12 my include a housing body 14 having a guide groove 13 of channel shape, and the guide groove 13 may be partitioned by opposite side walls 15 which are spaced apart from each other.

The cable end portion 10 may be inserted into the guide groove 13 to move along the guide groove 13, and the guide groove 13 can prevent the cable end portion 10 and the door latch cable 11 from being detached from the mounting housing 12.

The front and rear surfaces of the housing body 14 in a longitudinal direction of a vehicle may be respectively formed with a first and second mounting flange 16 and 17 to protrude along the longitudinal direction of a vehicle.

The case 30 may be provided with a catch housing 31 which the first mounting flange 16 is inserted into and caught by and a hanging flange 32 which the second mounting flange 17 is hanged at in a height direction of a vehicle and seated on.

The first mounting flange 16 is inserted into the catch housing 31 to be coupled thereto and the second mounting flange 17 is moved from the top to bottom in the height direction of a vehicle and coupled to the hanging flange 32 in a mounting process so that it cannot separated from the hanging flange 32 in the height direction of the vehicle.

A side surface of the second mounting flange 17 may be formed with a seating jaw 18 seated on the hanging flange 32 in order that the second mounting flange 17 cannot be separated from the hanging flange 32 downwardly in the height direction of the vehicle when the second mounting flange 17 is hanged at the hanging flange 32.

Explaining the process of mounting the door latch cable to the case 30 with reference to FIG. 4, in the assemble line of a vehicle, when, for example, the operator inserts the first mounting flange 16 into the catch housing 31 and then presses the second mounting flange 17 downwardly in the vehicle height direction, the second mounting flange 17 and the hanging flange 32 are slightly elastically deformed and then returned, and the seating jaw 18 is seated on the hanging flange 32 so that the second mounting flange 17 is coupled to the hanging flange 32.

Since the first mounting flange 16 is inserted into and coupled to the catch housing 31 by such a flange coupling, the mounting housing 12 does not move in the longitudinal direction of the vehicle and not separate from the case 30 in a state of being coupled to the case 30.

Further, since the second mounting flange 17 is hanged at and coupled to the hanging flange 32 in the height direction of the vehicle, the mounting housing 12 does not move in the height direction of the vehicle and not separate from the case 30.

On the other hand, in a state where the mounting housing 12 of the door latch cable is completely mounted on the case 30, the cable end portion 10 is seated on an extension surface 33 of the case 30*o* extending toward the inside of a passenger compartment so that the cable end portion 10 cannot fall downwards in the height direction of the vehicle.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A structure for connecting a door latch cable to a retractable outside door handle assembly for a vehicle, the structure comprising:

a mounting housing inserted into a case of the retractable outside door handle assembly in a longitudinal direction of the vehicle and hanged by and mounted at the case in a height direction of the vehicle, wherein the mounting housing comprises a housing body in which a guide groove is formed;

a door latch cable movably installed at the mounting housing; and a first mounting flange and a second mounting flange provided at a front surface and a rear surface of the housing body in the longitudinal direction of the vehicle, wherein the case is provided with a catch housing into which the first mounting flange is inserted to be hanged and a hanging flange into which the second mounting flange is hanged in the height direction of the vehicle and seated thereon.

2. The structure of claim 1, wherein a cable end portion, which is inserted into and is movable along the guide groove, is mounted at one end portion of the door latch cable.

3. The structure of claim 2, wherein the housing body comprises side walls defining the guide groove.

4. The structure of claim 3, the cable end portion is supported by the side walls.

5. The structure of claim 2, wherein the retractable outside door handle assembly for the vehicle is provided with a link pin, which is configured to pull and move the cable end portion according to operation of an outside door handle.

6. The structure of claim 1, wherein a side surface of the second mounting flange is provided with a seating jaw seated on the hanging flange when the second mounting flange is hanged at the hanging flange so that the second mounting flange does not fall from the hanging flange downwards in the height direction of the vehicle.

7. The structure claim 2, wherein the case is provided with an extension surface, the cable end portion being seated on and supported by the extension surface of the case.

8. A vehicle comprising:

a vehicle body;

a vehicle door attached to the vehicle body, the vehicle door having a retractable outside door handle assembly;

a mounting housing inserted into a case of the retractable outside door handle assembly in a longitudinal direction of the vehicle body and hanged by and mounted at the case in a height direction of the vehicle body, wherein the mounting housing comprises a housing body in which a guide groove is formed;

a door latch cable movably installed at the mounting housing, wherein a cable end portion, which is inserted into and is movable along the guide groove, is mounted at one end portion of the door latch cable; and a first mounting flange and a second mounting flange provided at a front surface and a rear surface of the housing body in the longitudinal direction of the vehicle body, wherein the case is provided with a catch housing into which the first mounting flange is inserted to be hanged and a hanging flange into which the second mounting flange is hanged in the height direction of the vehicle body and seated thereon.

9. The vehicle of claim 8, wherein the housing body comprises side walls defining the guide groove and the cable end portion is supported by the side walls.

10. The vehicle of claim 8, wherein the retractable outside door handle assembly is provided with a link pin, which is configured to pull and move the cable end portion according to operation of an outside door handle of the retractable outside door handle assembly.

11. The vehicle of claim 8, wherein a side surface of the second mounting flange is provided with a seating jaw seated on the hanging flange when the second mounting flange is hanged at the hanging flange so that the second mounting flange does not fall from the hanging flange downwards in the height direction of the vehicle body.

12. The vehicle claim 8, wherein the case is provided with an extension surface, the cable end portion being seated on and supported by the extension surface of the case.

13. A vehicle comprising:

a vehicle body;

a vehicle door attached to the vehicle body, the vehicle door having a retractable outside door handle assembly;

a mounting housing inserted into a case of the retractable outside door handle assembly in a longitudinal direction of the vehicle body and hanged by and mounted at the case in a height direction of the vehicle body, wherein the mounting housing comprises a housing body in which a guide groove is formed;

a door latch cable movably installed at the mounting housing, wherein a cable end portion, which is inserted into and is movable along the guide groove, is mounted at one end portion of the door latch cable; and a first mounting flange and a second mounting flange provided at a front surface and a rear surface of the housing body in the longitudinal direction of the vehicle body, wherein the case is provided with a catch housing into which the first mounting flange is inserted to be hanged and a hanging flange into which the second mounting flange is hanged in the height direction of the vehicle body and seated thereon;

wherein the housing body comprises side walls defining the guide groove and the cable end portion is supported by the side walls; and wherein the retractable outside door handle assembly is provided with a link pin.

14. The vehicle of claim 13, wherein the link pin is configured to pull and move the cable end portion according to operation of an outside door handle of the retractable outside door handle assembly.

15. The vehicle of claim 13, wherein a side surface of the second mounting flange is provided with a seating jaw seated on the hanging flange when the second mounting flange is hanged at the hanging flange so that the second mounting flange does not fall from the hanging flange downwards in the height direction of the vehicle body.

16. The vehicle of claim 13, wherein the case is provided with an extension surface, the cable end portion being seated on and supported by the extension surface of the case.

17. The structure of claim 3, wherein the housing body comprises side walls defining the guide groove.

18. The structure of claim 3, wherein the retractable outside door handle assembly for the vehicle is provided with a link pin, which is configured to pull and move the cable end portion according to operation of an outside door handle.

19. The structure of claim 3, wherein a side surface of the second mounting flange is provided with a seating jaw seated on the hanging flange when the second mounting flange is hanged at the hanging flange so that the second mounting flange does not fall from the hanging flange downwards in the height direction of the vehicle.

20. The structure claim 3, wherein the case is provided with an extension surface, the cable end portion being seated on and supported by the extension surface of the case.

* * * * *